US010913992B2

(12) United States Patent
Liu et al.

(10) Patent No.: US 10,913,992 B2
(45) Date of Patent: Feb. 9, 2021

(54) METHOD OF MANUFACTURING A CRYSTALLINE ALUMINUM-IRON-SILICON ALLOY

(71) Applicant: GM GLOBAL TECHNOLOGY OPERATIONS LLC, Detroit, MI (US)

(72) Inventors: Zhongyi Liu, Troy, MI (US); Tengjiao Qi, Clinton Township, MI (US); James R. Salvador, Royal Oak, MI (US); Ratandeep S. Kukreja, Warren, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 284 days.

(21) Appl. No.: 15/984,883

(22) Filed: May 21, 2018

(65) Prior Publication Data

US 2019/0352748 A1 Nov. 21, 2019

(51) Int. Cl.

| | |
|---|---|
| ***C22C 33/04*** | (2006.01) |
| ***C22C 33/00*** | (2006.01) |
| ***C22C 38/06*** | (2006.01) |
| ***C22C 38/02*** | (2006.01) |
| ***C21D 6/00*** | (2006.01) |

(52) U.S. Cl.

CPC ..... *C22C 33/04* (2013.01); *C21D 6/008* (2013.01); *C22C 33/006* (2013.01); *C22C 38/02* (2013.01); *C22C 38/06* (2013.01); *C22C 2200/00* (2013.01)

(58) Field of Classification Search

None

See application file for complete search history.

(56) References Cited

PUBLICATIONS

Marker, Dissertation. (Year: 2013).*

* cited by examiner

*Primary Examiner* — Xiaowei Su

(57) ABSTRACT

Provided is a method of manufacturing a crystalline aluminum-iron-silicon alloy, and optionally an automotive component comprising the same, comprising forming a composite ingot including a plurality of crystalline phases by melting aluminum, iron, and silicon raw materials in an inert environment to form a substantially homogenous melt, subsequently solidifying the melt, and annealing the ingot under vacuum by heating at a temperature in the range of 850° C. to 1000° C. yield an annealed crystalline ingot wherein the predominant crystalline phase is FCC $Al_3Fe_2Si$. The raw materials can further include one or more additives such as zinc, zirconium, tin, and chromium. Melting can occur above the FCC $Al_3Fe_2Si$ crystalline phase melting point, or at a temperature of about 1100° C. to about 1400° C. Annealing can occur under vacuum conditions.

14 Claims, 2 Drawing Sheets

METHOD OF MANUFACTURING A CRYSTALLINE ALUMINUM-IRON-SILICON ALLOY

INTRODUCTION

Iron aluminides (e.g., FeAl and $Fe_3Al$) are intermetallic compounds having a defined stoichiometry and an ordered crystal structure. Many iron aluminides exhibit excellent high-temperature oxidation resistance, relatively low densities, high melting points, high strength-to-weight ratios, good wear resistance, ease of processing, and low production cost since they generally do not incorporate rare elements, which makes them attractive substitutes for stainless steel in industrial applications. However, at low to moderate temperatures, iron aluminides oftentimes suffer from poor ductility and low fracture toughness. At elevated temperatures, iron aluminides have been found to exhibit limited creep resistance and high thermal conductivity. Increasing the aluminum content of such materials can decrease their density and enhance the formation of a protective oxide layer at high temperatures, but also may significantly lower their ductility in moisture-containing environments (e.g., air) due to a phenomenon known as hydrogen embrittlement.

Ternary Al—Fe—Si intermetallic compounds are of interest for alloy development due to their potential advantageous properties. In particular, the addition of silicon into the Al—Fe binary system has the potential to produce a ternary Al—Fe—Si intermetallic compound with a crystal structure that exhibits a combination of relatively low density and good mechanical properties, e.g., good stiffness and ductility. Therefore, there is a need in the art for a method of manufacturing a crystalline Al—Fe—Si alloy with a defined stoichiometry and an ordered crystal structure that exhibits a relatively low density and a desirable combination of good chemical, thermal, and mechanical properties.

SUMMARY

A method of manufacturing a crystalline aluminum-iron-silicon alloy is provided, and includes forming a composite ingot comprising a plurality of crystalline phases by melting aluminum, iron, and silicon raw materials in an inert environment to form a substantially homogenous melt and subsequently solidifying the melt, and annealing the ingot under vacuum by heating at a temperature in a range of 850° C. to 1000° C. to yield an annealed crystalline ingot. The predominant crystalline phase of the annealed crystalline ingot is FCC $Al_3Fe_2Si$. Melting can include heating to temperature of about 1100° C. to about 1400° C. Melting can include heating to a temperature above the FCC $Al_3Fe_2Si$ crystalline phase melting point. The substantially inert environment can include an argon atmosphere. Solidifying the melt can include cooling the melt in the inert environment to at least about 1050° C. Annealing can occur under a vacuum of pressures lower than about 60 mTorr. The composite ingot can include less than about 0.01% FCC $Al_3Fe_2Si$ crystalline phase. The annealed crystalline ingot can include less than about 1% triclinic Al—Fe—Si crystalline phases and less than about 5% hexagonal Al—Fe—Si crystalline phases. At least about 90% of the annealed crystalline ingot can include the crystalline FCC $Al_3Fe_2Si$ phase. The annealed ingot can include less than about 1% amorphous phase material. The method can further include grinding the composite ingot prior to annealing. The melt can include about 31% to about 35% aluminum, about 50% to about 55% iron, and about 11% to about 13% silicon.

A method of manufacturing a crystalline aluminum-iron-silicon alloy is provided. The method includes forming a composite ingot comprising a plurality of crystalline phases by melting aluminum, iron, and silicon raw materials at a temperature of at least about 1050° C. and subsequently solidifying the melt, and finally annealing the ingot by heating at a temperature up to about 1000° C. to yield an annealed crystalline ingot. At least about 90% of the annealed crystalline ingot comprises a FCC $Al_3Fe_2Si$ crystalline phase. Melting can occur in an inert environment. The melt can include about 31% to about 35% aluminum, about 50% to about 55% iron, and about 11% to about 13% silicon. Annealing can occur under a vacuum of pressures lower than about 60 mTorr. The composite ingot can include less than about 0.01% FCC $Al_3Fe_2Si$ crystalline phase.

A method of manufacturing an automotive component is provided. The method includes forming a composite ingot comprising a plurality of crystalline phases by melting aluminum, iron, and silicon raw materials in an inert environment at a temperature of about 1100° C. to about 1400° C. and subsequently solidifying the melt, and finally annealing the ingot under a vacuum of pressures lower than about 60 mTorr by heating at a temperature in a range of 850° C. to 1000° C. and subsequently cooling to yield an annealed crystalline ingot. At least about 90% of the annealed crystalline ingot comprises a FCC $Al_3Fe_2Si$ crystalline phase. The composite ingot can include less than about 0.01% FCC $Al_3Fe_2Si$ crystalline phase. The melt can include about 31% to about 35% aluminum, about 50% to about 55% iron, and about 11% to about 13% silicon.

Other objects, advantages and novel features of the exemplary embodiments will become more apparent from the following detailed description of exemplary embodiments and the accompanying drawings.

DETAILED DESCRIPTION

Figure 1:
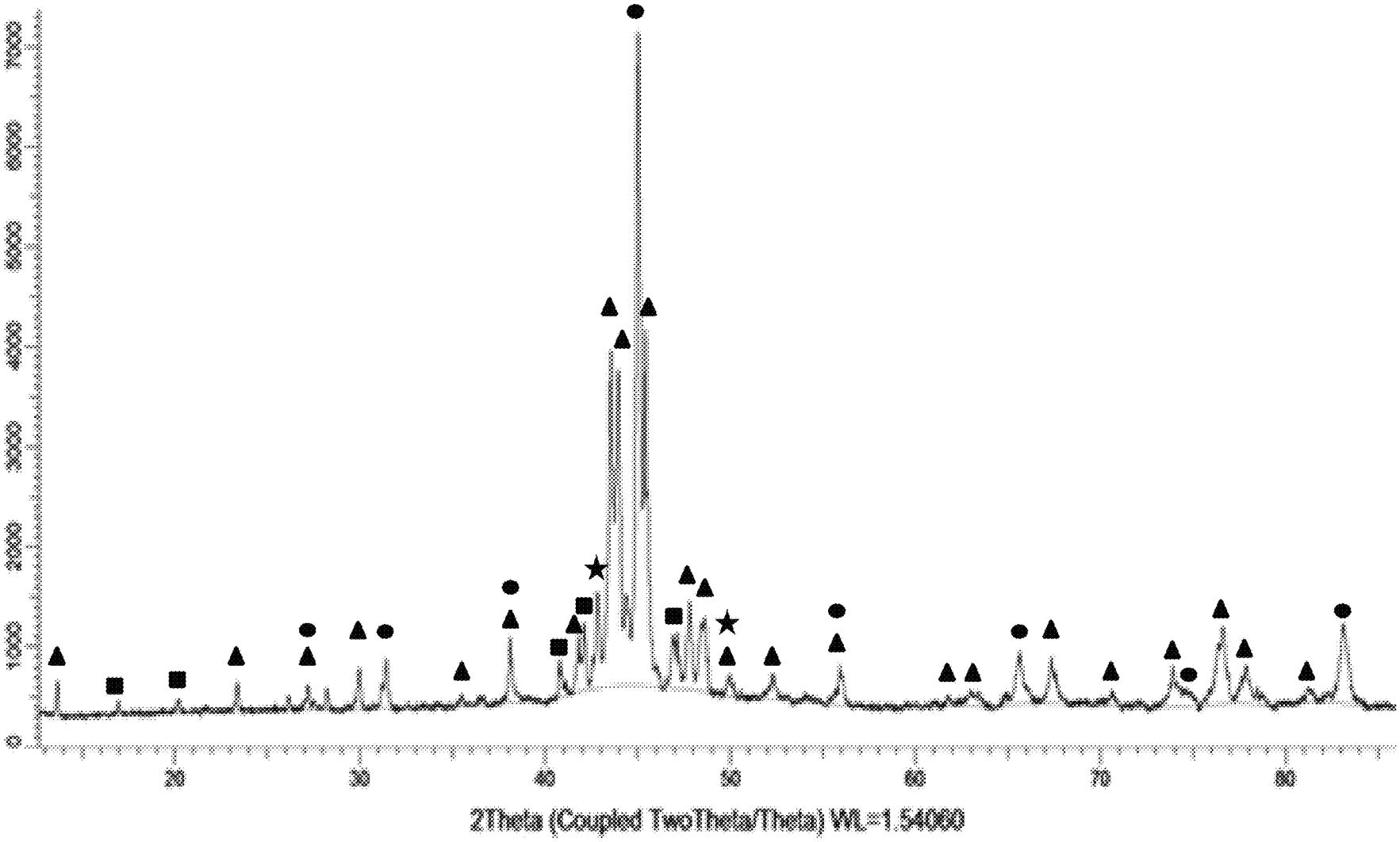
FIG. 1 illustrates an X-ray diffraction pattern of a melted composite ingot, according to one or more embodiments.

Aluminum, iron, and silicon are relatively abundant materials. Theoretically, iron aluminides (e.g., quasi-equilibrium cubic $Al_xFe_ySi_z$ ternary phases) have extreme properties at densities approaching titanium (e.g., less than 5 g/cm$^3$), but with costs that are an order of magnitude less than titanium. For example, cubic $Al_xFe_ySi_z$ phases have exceptional stiffness, high temperature strength, ductility (e.g., at least 5 slip systems in the crystal structure, where there are 12 slip systems in face-centered cubic (FCC) structures and up to 48 slip systems in body-centered cubic (BCC) systems), and tensile strength at room temperature (e.g., greater than or equal to 450 MPa). These phases also have high oxidation resistance due to the presence of large amounts of aluminum.

It is difficult to manufacture an Al—Fe—Si alloy with a predominant FCC $Al_3Fe_2Si$ crystalline phase without the use of expensive powdered materials, mechanical alloying, and/or other energy intensive processes. The presently disclosed melting and annealing methods can be used to manufacture a crystalline aluminum-iron-silicon alloy having a desired microstructure comprising predominantly the FCC $Al_3Fe_2Si$ crystalline phase. In addition, the presently disclosed melting and annealing heat treatment method can be used in combination with one or more powder metallurgical processes to manufacture shaped crystalline aluminum-iron-silicon alloy parts.

As used herein, the term "aluminum-iron-silicon alloy", or "Al—Fe—Si alloy" refers to a material that comprises aluminum (Al), iron (Fe), and silicon (Si). Al—Fe—Si alloys may further comprise one or more additives, including zinc (Zn), chromium (Cr), zirconium (Zr), and boron (B), among others. The particular Al—Fe—Si alloy of interest herein, and the intended product of all disclosed methods, is the intermetallic FCC $Al_3Fe_2Si$ crystalline phase characterized by lattice parameters of a=b=c=1.0806 nm, a cell parameter (A) of 10.806(2), an Fd-3m space group, a $NiTi_2$ structure type, and a cF96 Pearson symbol. Although named $Al_3Fe_2Si$ for simplicity, it is understood that the FCC $Al_3Fe_2Si$ phase may exhibit minor deviations in composition. For example, for the FCC phase $Al_xFe_ySi_z$, x can equal about 2.99 to about 3 and y can equal about 1.99 to about 2.25 such that z is normalized to equal 1. Expressed another way, the FCC phase $Al_3Fe_2Si$ can comprise about 48 atomic percent ("at. %") to about 50 at. % Al, about 33.3 at. % to about 36 at. % Fe, and about 16 at. % to about 16.7 at. % Si. Unless specified otherwise, a percentage ("%") refers to a percentage by weight.

Provided herein are melting and annealing methods which produce Al—Fe—Si alloys exhibiting the FCC $Al_3Fe_2Si$ crystalline phase as the predominant phase, and minimal, if any, amorphous phases, or undesired crystalline phases such as hexagonal or triclinic crystalline phases. Formation of FCC $Al_3Fe_2Si$ crystalline phase as the predominant phase in the crystalline Al—Fe—Si alloy, and preservation thereof at ambient temperature, can impart certain desirable properties to the crystalline Al—Fe—Si alloy. For example, the alloy may be relatively lightweight, may exhibit exceptional mechanical strength at high temperatures, high oxidation resistance, and relatively high stiffness and ductility, as compared to partially amorphous Al—Fe—Si alloys or Al—Fe—Si alloy in which other crystalline phases (i.e., non-FCC $Al_3Fe_2Si$ crystalline phases) predominate. As used herein in reference to a particular phase within the Al—Fe—Si alloy, the term "predominant" and its various word forms and conjugates means that such phase is the single largest phase in the Al—Fe—Si alloy by weight, with the weight fraction of the predominant phase in the Al—Fe—Si alloy being greater than the weight fraction of all other phases in the Al—Fe—Si alloy, taken individually or in combination.

The methods comprise first melting aluminum, iron, and silicon raw materials, and optionally one or more additive materials as identified below. One or more of the starting materials may be in the form of shot, pieces, or powder, among others. Advantageously, the raw materials can be provided in a non-powdered form, thereby avoiding the cost of powdered raw materials. The aluminum raw material purity can be as low as 95%, but 99% pure aluminum raw material is commonly available and suitable. For example, the aluminum raw material can comprise aluminum shot with a purity of about 99% to about 99.99% and about 5 mm to about 20 mm in diameter. The iron raw material purity can be as low as 95%, but 97% pure iron raw material is commonly available and suitable. For example, the iron raw material can comprise pieces (e.g., about 5 mm to about 40 mm in length and width, and about 1 mm to about 10 mm in thickness) with a purity of about 99% to about 99.99% The silicon raw material purity can be as low as 95%, but 99.9% purity aluminum raw material is commonly available and suitable. For example, the silicon raw material can comprise silicon shot or shards with a purity of about 99.9% and have various sizes.

The respective amounts of Al, Fe, and Si in the Al—Fe—Si alloy are selected to provide the alloy with the ability to develop a desired crystalline structure during manufacture. In particular, the respective amounts of Al, Fe, and Si in the Al—Fe—Si alloy are selected to provide the alloy with the ability to develop a crystalline structure that predominantly comprises the FCC phase $Al_3Fe_2Si$. It has been found that, in practice, the respective amounts of aluminum, iron, and silicon in the FCC $Al_3Fe_2Si$ crystalline phase in the crystalline Al—Fe—Si alloy may be somewhat different than the amounts predicted by the empirical formulas described above. For example, the raw materials in the melt can comprise about 31% to about 35% aluminum, about 50% to about 55% iron, and about 11% to about 13% silicon.

The Al—Fe—Si alloys can optionally further include one or more additives such as zinc, chromium, zirconium, and or boron, among others, as will be described below. These additives can be present in amounts of about 3% to about 10% of the alloy. Additional elements not intentionally introduced into the composition of the Al—Fe—Si alloy nonetheless may be inherently present in the alloy in relatively small amounts, for example, less than 4.5%, preferably less than 2.0%, and more preferably less than 0.02% by weight of the Al—Fe—Si alloy. Such elements may be present, for example, as impurities in the raw materials used to prepare the Al—Fe—Si alloy composition.

In some embodiments, the composition of the raw materials can comprise about 34% to about 35% aluminum, about 53% to about 54% iron, and about 11.5% to about 12.5% silicon. In one such an embodiment, the composition of the raw materials can comprise about 34.5% aluminum, about 53.5% iron, and about 12% silicon.

In some embodiments, the composition of the raw materials can comprise about 32.5% to about 33.5% aluminum, about 52.25% to about 53.25% iron, about 11.25% to about 12.25% silicon, and about 2% to about 3% zinc. In one such an embodiment, the composition of the raw materials can comprise about 33% aluminum, about 52.7% iron, about 11.8% silicon, and about 2.5% zinc. Such alloys can exhibit increased crystalline twinning due to the inclusion of zirconium and improved ductility, for example.

In some embodiments, the composition of the raw materials can comprise about 33% to about 34% aluminum, about 51% to about 52% iron, about 11% to about 12% silicon, about 2.25% to about 3.25% chromium, about 0.1% to about 0.4% zirconium, and up to about 0.1% boron. In one such an embodiment, the composition of the raw materials can comprise about 33.4% aluminum, about 51.9% iron, about 11.6% silicon, about 2.8% chromium, about 0.2% zinc, and about 0.07% boron. Such alloys can exhibit enhanced grain boundary refinement and improved ductility, for example.

In some embodiments, the composition of the raw materials can comprise about 31.5% to about 32.5% aluminum, about 50.5% to about 51.5% iron, about 11% to about 12% silicon, about 2% to about 3% zinc, about 2.25% to about 3.25% chromium, about 0.1% to about 0.4% zirconium, and up to about 0.1% boron. In one such an embodiment, the composition of the raw materials can comprise about 32% aluminum, about 51.1% iron, about 11.4% silicon, about 2.4% zinc, about 2.7% chromium, about 0.2% zinc, and about 0.07% boron. Such alloys can exhibit increased crystalline twinning, enhanced grain boundary refinement, and improved ductility, for example.

In some embodiments, the composition of the raw materials can comprise about 32% to about 33% aluminum, about 51.75% to about 52.75% iron, about 11% to about 12% silicon, and about 3% to about 4% zirconium. In one such an embodiment, the composition of the raw materials can comprise about 32.6% aluminum, about 52.3% iron, about 11.7% silicon, and about 3.4% zirconium. Such alloys can exhibit increased particle refinement due to the inclusion of zirconium, for example.

In some embodiments, the composition of the raw materials can comprise about 32% to about 33% aluminum, about 51.25% to about 53.25% iron, about 11% to about 12% silicon, and about 4% to about 5% tin. In one such an embodiment, the composition of the raw materials can comprise about 32.3% aluminum, about 51.7% iron, about 11.6% silicon, and about 4.4% tin. Such alloys can exhibit increased crystalline twinning due to the inclusion of tin, for example.

The raw materials are melted to form a generally homogenous melt at a temperature at least above the melting point of the FCC $Al_3Fe_2Si$ phase (~1050° C.). The melting temperature is maintained below the melting points of iron (~1538° C.) and silicon (~1414° C.) and optionally below any additives, with the exception of zinc and tin. Accordingly, in some embodiments, the raw materials are melted at a temperature of at about 1050° C., at a temperature of about 1100° C. to about 1400° C. Increased additives in the Al—Fe—Si alloy can require higher melting temperatures. The raw materials can be melted in a boron nitride crucible, for example. The raw materials may alternatively be melted in a mold, such as an automotive component mold. In such embodiments which utilize an automotive component mold or the like, the composite ingot comprises an automotive component. The raw materials can be melted in an inert environment such that undesired oxidation or phase formation is precluded. An inert environment can comprise an argon and/or neon atmosphere, for example.

The melt is subsequently solidified to form a composite ingot. After melting is complete, the melt can be cooled within the inert environment, until the melt solidifies or substantially solidifies (typically around about the melting point of the FCC $Al_3Fe_2Si$ phase), in order to minimize macro-porosity. In some embodiments, the melt is slowly cooled within the inert environment until reach of a temperature of about 1100° C. down to about 1000° C. The composite ingot may further cool to ambient temperature under ambient atmospheric conditions. Prior to annealing, the composite ingot can optionally be ground to particle sizes which exhibit characteristics (e.g., tap density and flowability) suitable for powder metallurgy processes. Grinding can be conducted with a roller mill, a ball mill, or other suitable means. The composite ingot can be ground to a particle side of about 50 μm to about 500 μm, for example.

The composite ingot can comprise one or a plurality of crystalline phases, and optionally one or more amorphous phases. For example, the composite ingot can comprise an $Fe_{1.7}Al_4Si$ hexagonal (P63/mmc) crystalline phase, an $Fe_3Al_{0.25}Si_{0.75}$ cubic (Fm-3m) crystalline phase, and an $Fe_3Al$ Cubic (Pm-3m) crystalline phase. Accordingly, there may be one or more non-Al—Fe—Si crystalline phases (e.g., an $Fe_3Al$ Cubic (Pm-3m) crystalline phase). In some embodiments, the composite ingot can comprise less than about 0.01% FCC $Al_3Fe_2Si$ crystalline phase, or substantially no FCC $Al_3Fe_2Si$ crystalline phase.

The composite ingot is subsequently annealed at temperatures below the melting point of the FCC $Al_3Fe_2Si$ crystalline phase to yield an annealed crystalline ingot. Annealing yields an annealed crystalline ingot wherein the FCC $Al_3Fe_2Si$ crystalline phase is the predominant crystalline phase. Further, the annealed crystalline ingot comprises very little, or substantially no amorphous phases or low-symmetry crystalline phases such as triclinic Al—Fe—Si (e.g., $Fe_3Al_2Si_3$) crystalline phases. In some embodiments, at least about 80%, at least about 85%, or at least about 90% of the annealed crystalline ingot comprises the crystalline FCC $Al_3Fe_2Si$ phase. Additionally or alternatively, in some embodiments the annealed crystalline ingot comprises less than about 1% amorphous phase material. Additionally or alternatively, in some embodiments the annealed crystalline ingot comprises less than about 1% triclinic Al—Fe—Si crystalline phases. Additionally or alternatively, in some embodiments the annealed crystalline ingot comprises less than about 5% hexagonal Al—Fe—Si (e.g., $Fe_3Al_2Si_3$) crystalline phases.

Annealing occurs at temperatures of at least about 800° C., at least about 825° C., or at least about 850° C. In some embodiments, annealing occurs at a temperature in the range of about 850° C. to about 950° C., or about 850° C. to about 1000° C. Increasing the annealing temperature can reduce the annealing time, which can be optimized to a particular alloy composition. The composite ingot can be annealed for a period of time which suitably forms the desired quantity of FCC $Al_3Fe_2Si$ crystalline phase. In some embodiments, the composite ingot can be annealed for about 2 hours to about 24 hours.

Annealing can occur in a vacuum environment and/or an inert environment. In some embodiments, annealing occurs at high vacuum. "High vacuum" conditions can comprise about 60 mTorr to about 0.001 mTorr, or more preferably about 6 mTorr to about 0.001 mTorr. Vacuum environments can accomplish the same objectives as inert environments (e.g., argon environments), but can be less applicable for alloys comprising relatively volatile additives such as zinc, for example. In some embodiments, annealing occurs in an argon atmosphere. In some embodiments, annealing occurs under vacuum and in an argon atmosphere. In some embodiments, annealing occurs in a $N_2$ atmosphere, for example where forming a nitride layer on the composite ingot is desired. After annealing, the annealed crystalline ingot can be cooled The qualities of the stable FCC $Al_3Fe_2Si$ crystalline phase alloys render them suitable for components of an automobile or other vehicle (e.g., motorcycles, boats). As examples, the stable FCC $Al_3Fe_2Si$ crystalline phase alloys may be suitable for forming lighter engine valves or other lightweight valves, for forming lightweight pistons, for forming rotating and reciprocating parts of an internal combustion engine, and/or for use in turbocharger applications (e.g., forming turbocharger wheels). The stable FCC $Al_3Fe_2Si$ crystalline phase alloys may also be used in a variety of other industries and applications, including, as non-limiting examples aerospace components, industrial equipment and machinery, farm equipment, and/or heavy machinery. In some embodiments components may be formed into a desired shape during the melting steps. Alternatively, the annealed crystalline ingots may be subsequently formed into components (e.g., automotive components) using any suitable technique, such as rolling, forging, stamping, powder metallurgy, or casting (e.g., die casting, sand casting, permanent mold casting, etc.), among others.

EXAMPLES

Aluminum, iron, and silicon raw materials were combined to form a 400 g melt comprising 35% aluminum, 53% iron, and 12% silicon. The raw materials were melted at 1200° C. for 5 minutes to form a cylindrical composite ingot approximately 3.8 cm in diameter and 7.7 cm in height. X-ray diffraction (XRD) was performed on the resulting composite ingot using a D8-Advance Davinci diffractometer in a Bragg Brentano configuration using copper Kα radiation. Data was collected from 10°-90° 2θ using a 0.02° step size and an integration time of 1 sec/step. Rietveld refinement was performed using DIFFRAC. SUITE TOPAS software. FIG. 1 illustrates an XRD pattern of the as-prepared composite ingot. The XRD pattern of the as-prepared composite ingot indicates a composition of about 72% $Fe_{1.7}Al_4Si$ hexagonal (P63/mmc) crystalline phase (indicated by triangles in FIG. 1), about 23% $Fe_3Al_{0.25}Si_{0.75}$ cubic (Fm-3m) crystalline phase (indicated by circles in FIG. 1), about 5% $Fe_3Al$ Cubic (Pm-3m) crystalline phase (indicated by stars in FIG. 1), and unidentifiable phases (indicated by squares in FIG. 1).

Figure 2:
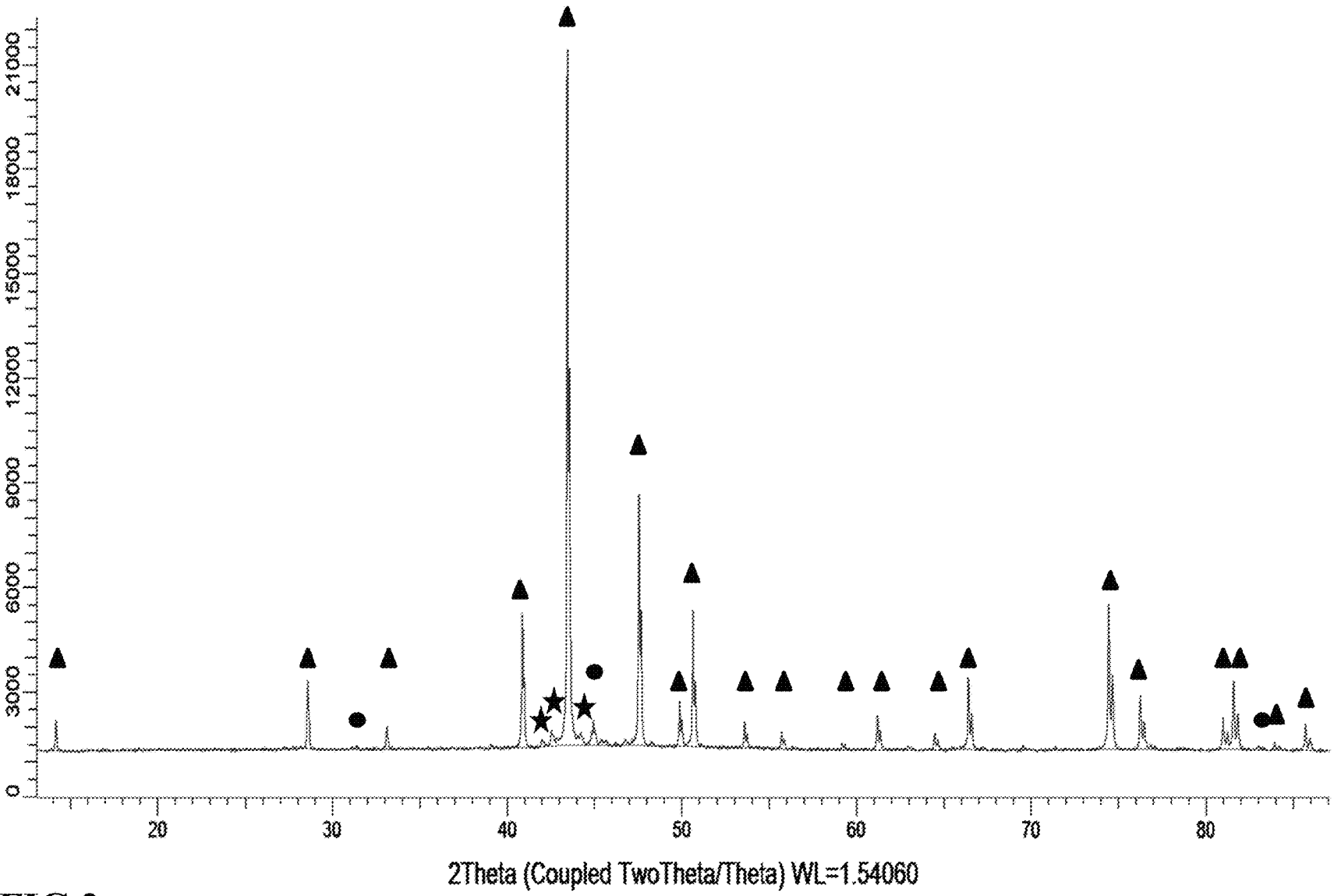
FIG. 2 illustrates an X-ray diffraction pattern of an annealed crystalline ingot, according to one or more embodiments.

The composite ingot was subsequently annealed at 950° C. for 24 hours under a vacuum of 0.01 mTorr to form an annealed crystalline ingot. XRD was performed on the resulting crystalline ingot using a D8-Advance Davinci diffractometer in a Bragg Brentano configuration using copper Kα radiation. Data was collected from 10°-90° 2θ using a 0.02° step size and an integration time of 1 sec/step. Rietveld refinement was performed using DIFFRAC. SUITE TOPAS software. FIG. 2 illustrates an XRD pattern of the as-prepared annealed crystalline ingot. The XRD pattern of the as-prepared crystalline ingot indicates a composition of about 92% $Fe_2Al_3Si$ FCC (Fd-3m) crystalline phase (indicated by triangles in FIG. 2), about 5% $Fe_3Al_{0.25}Si_{0.75}$ FCC (Fm-3m) crystalline phase (indicated by circles in FIG. 2), and about 3% $Fe_{23}Al_{81}Si_{15}$ Hexagonal (P63/mmc) crystalline phase (indicated by stars in FIG. 2). These results indicate that a crystalline ingot or automotive component can be formed with a high amount of FCC $Fe_2Al_3Si$ crystalline phase without the use of powdered raw materials or mechanical alloying. Similar results can be achieved with only about 8 hours of annealing under like conditions.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A method of manufacturing a crystalline aluminum-iron-silicon alloy, the method comprising:

forming a composite ingot comprising a plurality of crystalline phases by melting aluminum, iron, and silicon raw materials in an inert environment to form a substantially homogenous melt and subsequently solidifying the melt; and annealing the ingot under vacuum by heating at a temperature in a range of 850° C. to 1000° C. to yield an annealed crystalline ingot wherein at least about 90 wt. % of the annealed crystalline ingot is a crystalline FCC $Al_3Fe_2Si$ phase.

2. The method of claim 1, wherein melting comprises heating to temperature of about 1100° C. to about 1400° C.

3. The method of claim 1, wherein melting comprises heating to a temperature above the FCC $Al_3Fe_2Si$ crystalline phase melting point.

4. The method of claim 1, wherein the substantially inert environment comprises an argon atmosphere.

5. The method of claim 1, wherein solidifying the melt comprises cooling the melt in the inert environment to at least about 1050° C.

6. The method of claim 1, wherein annealing occurs under a vacuum of pressures lower than about 60 mTorr.

7. The method of claim 1, wherein the composite ingot comprises less than about 0.01 wt. % FCC $Al_3Fe_2Si$ crystalline phase.

8. The method of claim 1, wherein the annealed crystalline ingot comprises less than about 1 wt. % triclinic Al—Fe—Si crystalline phases and less than about 5 wt. % hexagonal Al—Fe—Si crystalline phases.

9. The method of claim 1, wherein the annealed ingot comprises less than about 1 wt. % amorphous phase material.

10. The method of claim 1, further comprising grinding the composite ingot prior to annealing.

11. The method of claim 1, wherein the melt comprises about 31 wt. % to about 35 wt. % aluminum, about 50 wt. % to about 55 wt. % iron, and about 11 wt. % to about 13 wt. % silicon.

12. A method of manufacturing an automotive component, the method comprising:

forming a composite ingot comprising a plurality of crystalline phases by melting aluminum, iron, and silicon raw materials in an inert environment at a temperature of about 1100° C. to about 1400° C. and subsequently solidifying the melt; and annealing the ingot under a vacuum of pressures lower than about 60 mTorr by heating at a temperature in a range of 850° C. to 1000° C. and subsequently cooling to yield an annealed crystalline ingot wherein at least about 90 wt. % of the annealed crystalline ingot is a FCC $Al_3Fe_2Si$ crystalline phase.

13. The method of claim 12, wherein the composite ingot comprises less than about 0.01 wt. % FCC $Al_3Fe_2Si$ crystalline phase.

14. The method of claim 12, wherein the melt comprises about 31 wt. % to about 35 wt. % aluminum, about 50 wt. % to about 55 wt. % iron, and about 11 wt. % to about 13 wt. % silicon.

* * * * *